US009731945B2

(12) United States Patent
Melin et al.

(10) Patent No.: US 9,731,945 B2
(45) Date of Patent: Aug. 15, 2017

(54) SAFETY ARRANGEMENT FOR A PORTABLE POWER DRIVEN SYSTEM

(71) Applicant: Actsafe Systems AB, Lindome (SE)

(72) Inventors: Michael Melin, Göteborg (SE); Peter Sundman, Vallda (SE)

(73) Assignee: ACTSAFE SYSTEMS AB, Lindome (SE)

( * ) Notice: Subject to any disclaimer, the term of this patent is extended or adjusted under 35 U.S.C. 154(b) by 545 days.

(21) Appl. No.: 14/526,944

(22) Filed: Oct. 29, 2014

(65) Prior Publication Data

US 2015/0123058 A1 May 7, 2015

(30) Foreign Application Priority Data

Nov. 4, 2013 (EP) ..... 13191454

(51) Int. Cl.
*B66D 1/74* (2006.01)
*A62B 1/06* (2006.01)
*B66D 1/12* (2006.01)

(52) U.S. Cl.
CPC ..... *B66D 1/7489* (2013.01); *A62B 1/06* (2013.01); *B66D 1/12* (2013.01); *B66D 1/7415* (2013.01)

(58) Field of Classification Search
CPC ..... B66D 1/12; B66D 1/7415; B66D 1/7489; B66D 3/046; B66D 3/26; A62B 1/06
See application file for complete search history.

(56) References Cited

U.S. PATENT DOCUMENTS

| | | | | |
|---|---|---|---|---|
| 4,058,294 | A | 11/1977 | Dressler | |
| 4,325,537 | A * | 4/1982 | Winter | B66D 3/046 114/204 |
| 6,412,602 | B1 | 7/2002 | Sundman | |
| 7,513,334 | B2 * | 4/2009 | Calver | B66D 1/7415 182/133 |
| 2015/0246796 | A1 * | 9/2015 | Melin | B66D 3/20 254/362 |
| 2017/0107086 | A1 * | 4/2017 | Boulliat | B66D 1/7415 |

FOREIGN PATENT DOCUMENTS

| | | |
|---|---|---|
| WO | WO2004065280 | 8/2004 |
| WO | WO2011036520 | 3/2011 |

OTHER PUBLICATIONS

Sevda Ozsoy, European Search Report for application EP 13191454.1, Mar. 19, 2014, The Hague, The Netherlands.

* cited by examiner

*Primary Examiner* — Sang Kim
*Assistant Examiner* — Nathaniel Adams
(74) *Attorney, Agent, or Firm* — Babcock IP, PLLC

(57) ABSTRACT

The present invention relates to a safety arrangement for a portable power driven system, such as an ascender/descender arrangement, specifically in relation to safety means for minimizing risks with items rotating during the operation of the power driven system.

9 Claims, 7 Drawing Sheets

SAFETY ARRANGEMENT FOR A PORTABLE POWER DRIVEN SYSTEM

TECHNICAL FIELD

The present invention relates to a safety arrangement for a portable power driven system, such as an ascender/descender arrangement, specifically in relation to safety means for minimizing risks with items rotating during the operation of the power driven system.

BACKGROUND OF THE INVENTION

Powered personal lifting devices assist personnel in scaling vertical surfaces. Motorized winches are used to raise or lower personnel on platforms or harnesses attached to ropes. A winch must be anchored to a solid platform above the load or use pulleys coupled to the platform to hoist the load. Further, a winch winds the rope or cable on a spool which limits the length and weight of rope that can be used. Hoists, usually with compound pulleys or reducing gears are used to raise or lower individuals or platforms and must be suspended from a secure support point such as a tripod, beam or bridge crane. Typically a winch or hoist requires at least a second person to operate or control the device in order for a first person to safely ascend a rope.

There are however many examples of where it would be desirable to have access to a portable winch, preferable for a portable winch that can be operated by the person ascending or descending the rope. Such scenarios include for example mountain climbing, caving, tree trimming, rescue operations and military operations. Industrial uses of a climbing device may include scaling tall structures, towers, poles, mine shafts or bridge works for servicing, cleaning, window washing, painting, etc.

An example of such a portable winch is disclosed in U.S. Pat. No. 6,412,602. In U.S. Pat. No. 6,412,602 there is provided a promising approach to a portable climber operated winch, denoted as a climbing device, comprising a rotatable rope pulley connected to a motor, such as for example an internal combustion motor or an electric battery powered motor. During operation of the climbing device a rope is introduced in the rope pulley, and once the motor is engaged and starts to rotate, the rope pulley may advance the climber in a typically vertical direction along the rope.

Even though the above mentioned prior art shows a very useful solution for rope access to heights, there is always an endeavor to introduce further improvements for the personnel utilizing the equipment. Specifically, there is a desire to minimize any risks when working at heights, thereby improving the environment for the user of such equipment.

SUMMARY OF THE INVENTION

According to a first aspect of the invention, the above is at least partly alleviated by a portable power driven system for advancing a rope, the rope extending in a first main direction, the power driven system comprising a motor, the motor comprising a drive shaft, a rope grab configured to receive the rope, the rope grab connected to the drive shaft of the motor for rotation of the rope grab, a hinged safety arrangement comprising a safety lid configured to be arranged in a closed state to fully cover the rope grab during operation of the power driven system, and to be arranged in an opened state for allowing introduction of the rope to the robe grab, and an anchoring point adapted to receive an anchoring force, the anchoring force extending in a second direction being essentially opposite to the first main direction, wherein the hinged safety arrangement further comprises a leaver portion connected to and extending in an angle to the safety lid, the anchoring point being arranged at the leaver portion, wherein the safety lid and the leaver portion are arranged essentially perpendicular to each other, whereby the anchoring force when acting on the anchoring point forces the safety lid to its closed state.

The invention is based on the understanding that the anchoring force received by the portable power driven system during its operation, for example when a user is ascending or descending the rope in a vertical manner and in such case is secured to the anchoring point of the portable system, efficiently may be used also for securing the safety lid in its closed state where it fully covers the rope grab, thereby reducing any risks of the user coming in contact with the rotating rope grab.

According to the invention, the safety lid and the leaver portion are arranged essentially perpendicular to each other. It may of course in some implementations be necessary to make adjustments to such an arrangement, still typically allowing the leaver portion to be extending in an increased or decreased angle as compared to a perpendicular extension.

In accordance with the present invention, the anchoring force will act on the leaver portion of the safety arrangement, which in turn is attached to a fixed point, i.e. the hinge of the safety arrangement. Accordingly, the lever portion, which in turn is connected to the safety lid, will force the safety lid to its closed state.

The robe grab may in one embodiment comprise a roller (may as be referred to as a rope pulley) formed to at least partly pinch the rope by means of a concave form such as a v- or u-shaped rope engaging face, the rope engaging face formed at the "inside" of the roller for receiving the rope. The inside of the roller may additionally comprise a plurality of ridges for further increasing the friction between the rope and the roller.

As mentioned above, the motor is connected to the rope gram using the drive shaft. The expression "drive shaft" may include any mechanical implementation for transferring a rotational force from the motor to the rope grab. As such, the drive shaft may for example further include a gearbox or similar for adapting the rotational force to suit the rotational speed of the rope grab.

The term rope is here used in its broader sense and is intended to include ropes, wires and cords of whatever nature or size suitable for engaging with the rope grab.

According to an embodiment, the portable power driven system further comprises a main body for mounting the hinged safety arrangement. The main body may typically be seen as a chassis for the portable system, providing support for the elements of the system as well as for mounting the hinges safety arrangement in connection and close vicinity to the rope grab.

In a typical embodiment of the invention, the safety lid and the leaver portion are formed from one piece of material, such as from a single piece of metal. It may of course be possible, and within the scope of the invention, to implement the safety arrangement using two pieces of material, i.e. one for the safety lid and one for the lever portion. As understood by the skilled addressee, the leaver portion as well as the part of the safety arrangement in fact connecting to the hinge must typically (but not necessarily) be made of a sturdy material such as metal to withheld the anchoring force acting on the portable system (such from a user connected to the anchoring point and hanging freely from the system). However, the safety lid could in one embodiment be made of a separate piece of material, e.g. a composite material for reducing the total weight of the portable system.

Preferably, the leaver portion comprises an elongated pin, the elongated pin provided for receiving the anchoring force. Such a pin, or possibly as an alternative a bolt or similar, may allow for the further connection of an elongated sling, for example of a textile material. The elongated sling is preferably at one of its ends arranged to enclose a portion of the elongated pin and configured to at its other end receive at least one of a maillon, a carabiner, or a rigging plate. The at least one of a maillon, a carabiner, or a rigging plate may then in turn be used for allowing connection of the portable system to e.g. a harness for a user, or for anchoring the system to a fixed structure using e.g. further climbing/fining equipment. Other types of devices for connection to the sling, pin/bolt, or anchoring point are of course possible and within the scope of the invention. In a similar manner, the general term "elongated sling" is typically referred to as in relation to general climbing equipment. In addition, the term "textile" should be interpreted very broadly. For example, the textile material used for forming the sling may be of any type of e.g. woven or non-woven material, natural and/or synthetic fibers, etc.

For allowing full portability of the system, the motor is preferably one of an internal combustion engine or an electrical motor further comprising a rechargeable battery. In case of using an internal combustion engine, the system will further comprise a container for holding an adequate amount of fuel for operating the motor. Similarly, in case of using an electrical motor the rechargeable battery may be detachably connected to the system for allowing swift exchange of power source in case of an empty battery. However, such an electrically powered system may of course instead or also include an internally non-detachable but still rechargeable battery.

Advantageously, the portable system additionally comprises a user interface for operating the motor for allowing rotation of the rope grab in a first and a second direction, e.g. for allowing a user to ascend and descend along the rope in a vertical fashion. The user interface may generally differ based on the type of motor used for the portable system. In addition, the portable system may further comprise wireless reception means thereby allowing the system to be controlled from a distance using for example a remote control.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
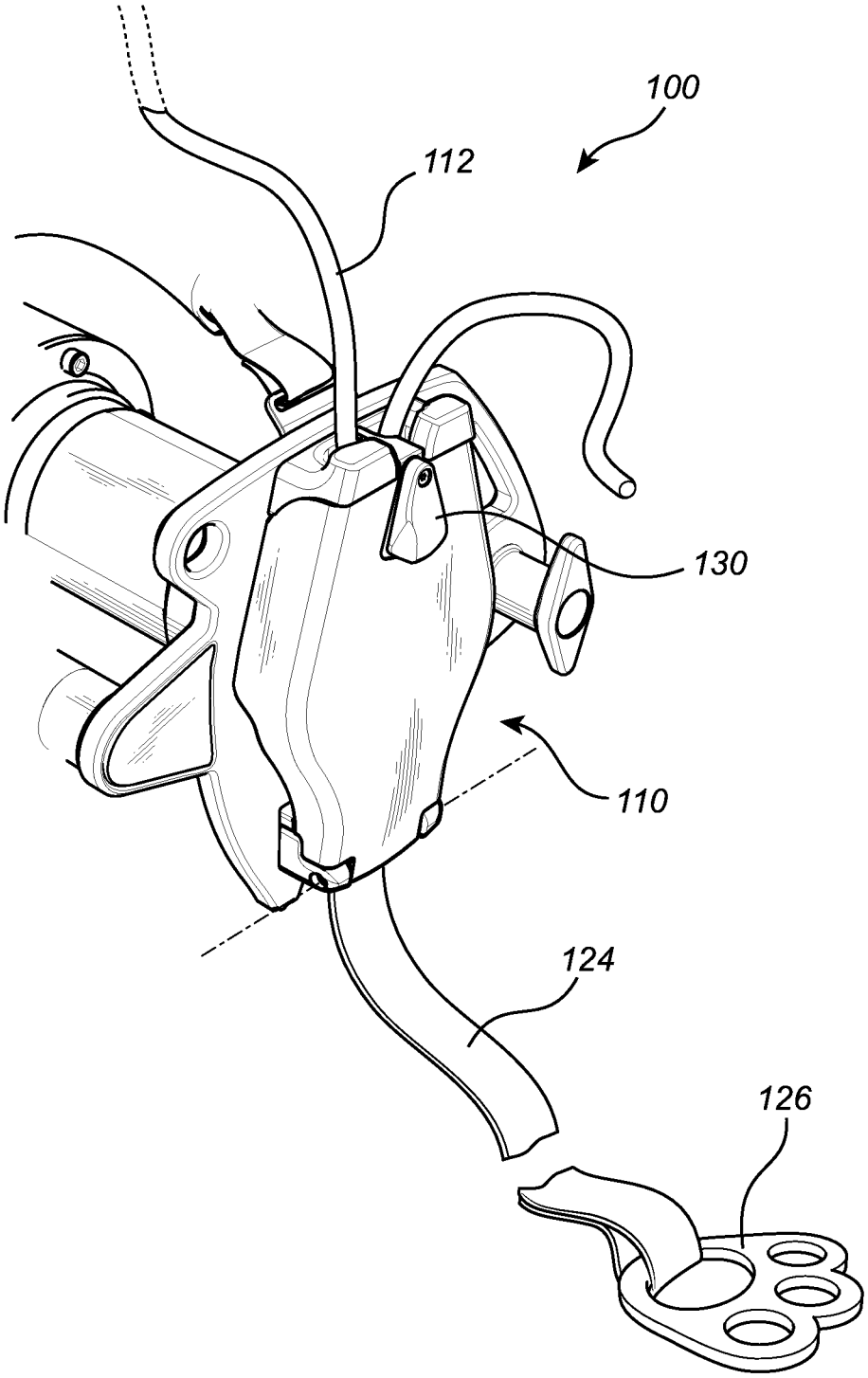
FIG. 1 shows a section of a portable power driven system according to the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Figure 2:
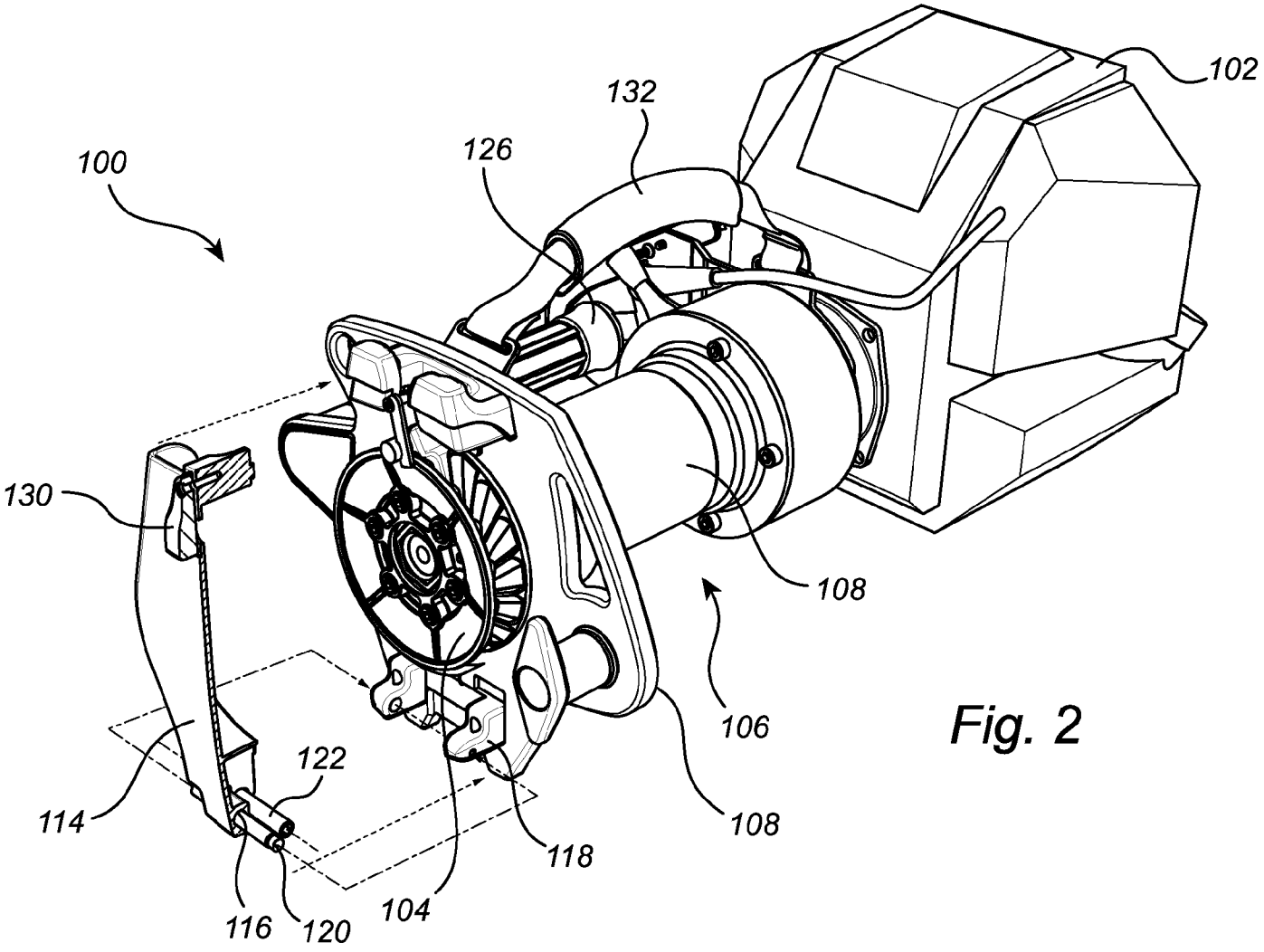
FIG. 2 shows a detailed partially exploded view of the power driven system.

Referring now to the drawings and to FIGS. 1 and 2 in particular, there is depicted a portable power driven system 100 according to a possible embodiment of the invention. The power driven system 100 comprises a motor 102 and a rope grab 104, the motor 102 and the rope grab 104 being connected to each other by means of for example a drive shaft 106 (possibly also including a gearbox or similar). The motor is preferably one of an internal combustion engine or an electrical motor further comprising a rechargeable battery. In the illustrated embodiment the drive shaft 106 is enclosed in a main body 108 of the system 100. The system 100 further comprises a hinged safety arrangement 110 for fully covering the rope grab 104, the rope grab 104 being configured for receiving and advancing a rope 112 once the motor by means of the drive shaft 106 rotates the rope grab 104.

The hinged safety arrangement 110 includes a safety lid 114 and a leaver portion 116, together configured to engage with a hinge device 118/120 connected to the main body 108. The leaver portion 116 in turns includes an anchoring point, typically implemented with an elongated pin 122, bolt or similar. In addition, for introducing an anchoring force to the system 100, an elongated textile safety sling 124 is provided, the sling 124 being in one end connected to the elongated pin 122 and in the other end connected to for example a rigging plate 126. Other alternative types of similar devices may be used instead of the rigging plate 126, such as for example a maillon or a carabiner. The rigging plate 126 (or similar) may in turn allow a user to connect his/her safety harness (not shown) to the system 100 during its operation.

As discussed above, the safety lid 114 and the leaver portion 116 may be formed from a single piece of material, for example of a metal material. However, other types of combinations are possible, for example by forming the safety lid 114 from a composite (plastic) material and the leaver portion from a metal material.

In addition, the portable system 100 further comprises a user interface 128 for controlling the motor 102. The user interface 128 will typically have a motor type dependent implementation (e.g. mechanical and/or electrical control). Furthermore, the safety arrangement 110 may additionally comprise a locking/unlocking mechanism 130 for opening/closing the safety arrangement 104. In addition, the system 100 typically further comprises a handle 132 for allowing the system 100 to be easily transported.

Figure 3A:
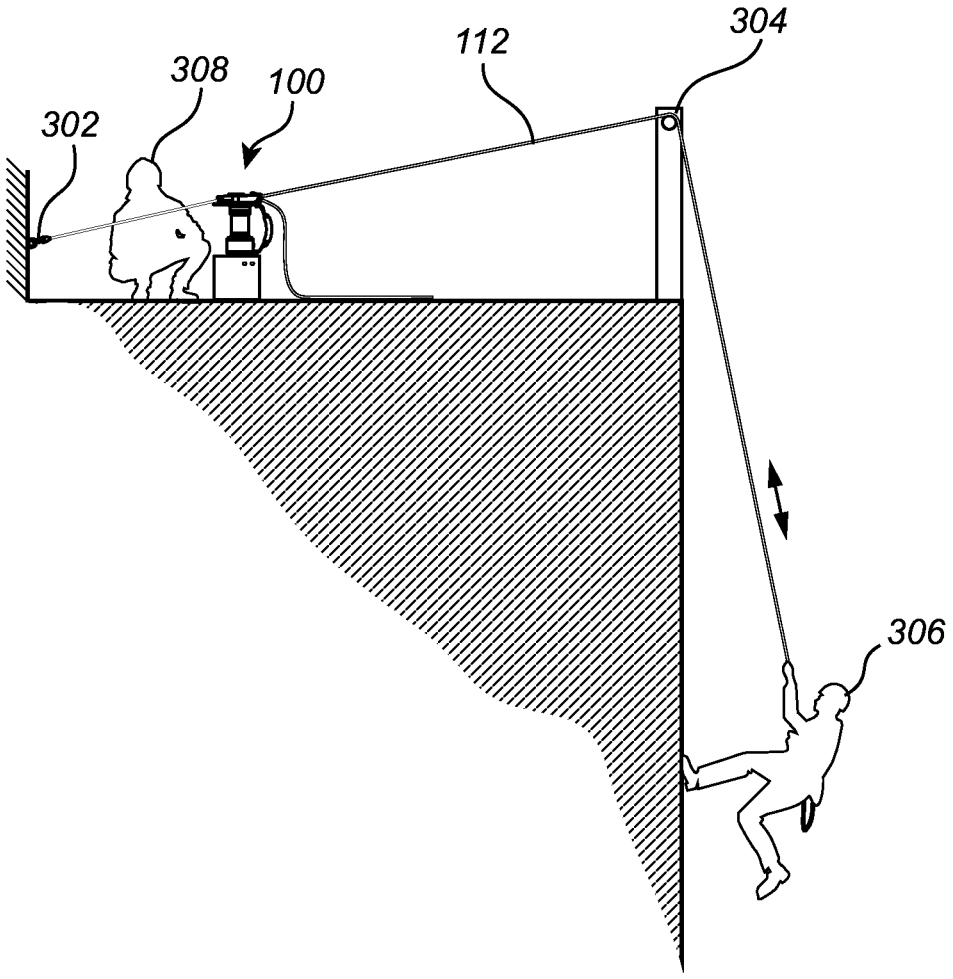
FIGS. 3*a*-3*c* illustrates a horizontal operation of the power driven system.
Figure 3B:
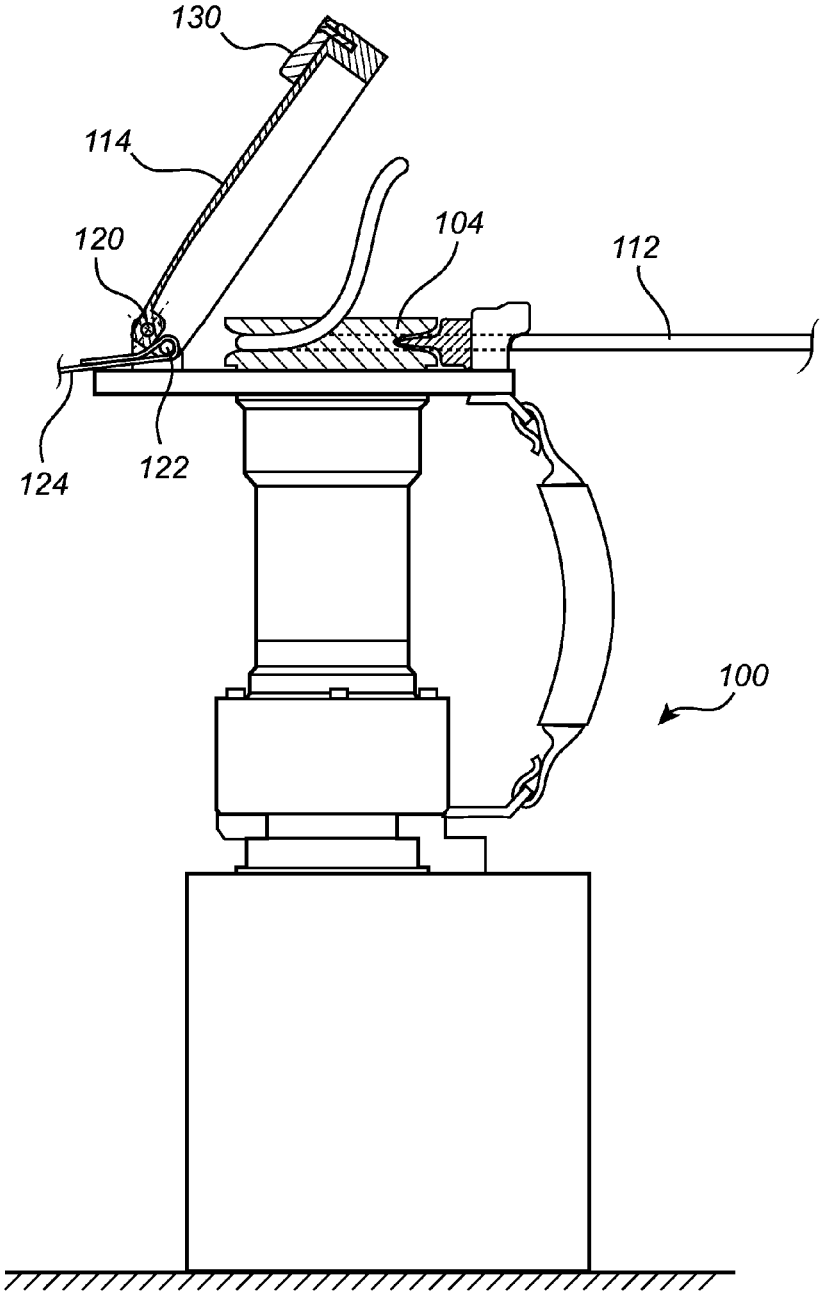
Figure 3C:
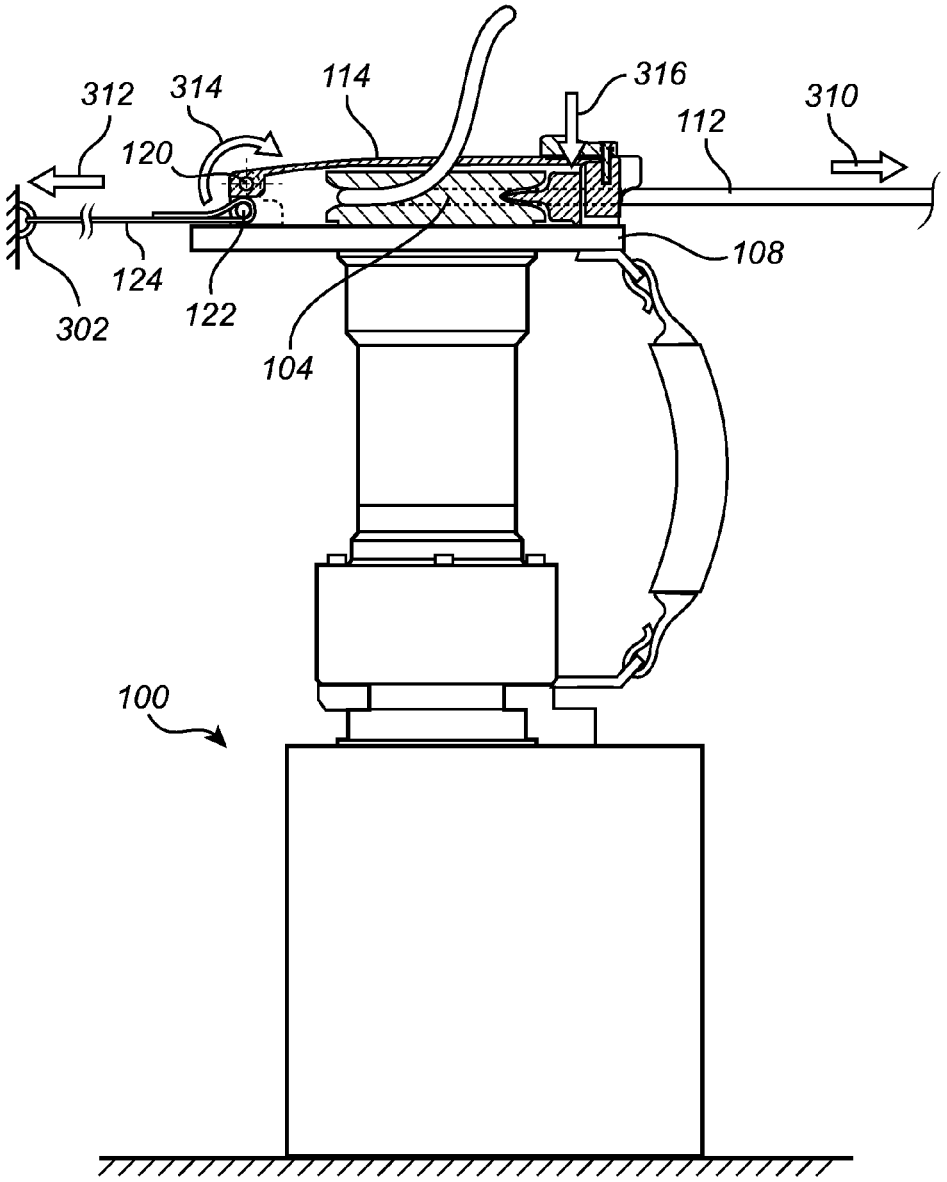

Turning now to FIGS. 3*a*-3*c*, which illustrates an exemplary horizontal operation of the power driven system 100. In the embodiment of FIGS. 3*a*-3*c*, the system 100 is arranged as a standalone winch mode, i.e. instead of the user connecting his/her safety harness directly to the elongated pin 122 (the anchoring point) and using the system 100 to ascend/descend along the rope (as will be shown below in relation to the description of FIGS. 4*a*-4*b*), the system 100 is in this mode connected to a fixed structure such as a wall or similarly available object at the operational site.

In the illustrated example, the rope 112 is configured to pass over e.g. a roller 304 for the purpose of allowing a user 306 to be transporter in a vertical manner without having to himself control the system 100. The system may instead (or also) be controlled by an operator 308 using the user interface 128, the operator typically situated adjacently to the system 100. It may however be possible to configure the system 100 to additionally comprise means to be controlled from a distance, for example by means of a remote control (wired or wireless, not shown). Preferably, the control is wireless and in such an implementation the system 100 comprises wireless connection means to communicate wirelessly with the remote control.

FIG. 3*b* provides an illustration for introducing the rope 112 into the rope grip 104, in the case where the hinged safety arrangement 110 is arranged in its opened state. The open state gives a user full access to the rope grip 104.

In FIG. 3*c*, the hinged safety arrangement 110 is instead arranged in its closed state. As can be seen, the system 100 is here (statically) connected to the fixed structure 302 by means of the sling 124 and possible further climbing/fastening equipment. Once the rope 112 is tightened (e.g. by the weight of the user 306 connected to the rope 112 as seen in FIG. 3*a*, the rope extending in a first main direction 310) an anchoring force will automatically be applied in an essentially opposite second direction 312 by the sling 124 that is connected to the elongated pin 122. As discussed, the elongated pin 122 is arranged at the leaver portion 116 of the safety arrangement 110 and will, using the fixed hinge 116 connected to the main body 108, turn 314 the safety lid 114 in a direction 316 such that the safety lid 114 enters into its closed state, efficiently covering the rope grip 104. The safety arrangement 110 will of course be implemented to withhold at least the weight of e.g. the user 306.

As such, the higher the anchoring force applied to the leaver portion 116 (the elongated pin 122), the higher the force applied for closing the safety lid 114. Accordingly, even in a case where the function of the locking/unlocking mechanism 130 would fail, the safety lid 114 would tightly cover the rope gripe 104 as long as an anchoring force is applied to the lever portion 116.

Figure 4A:
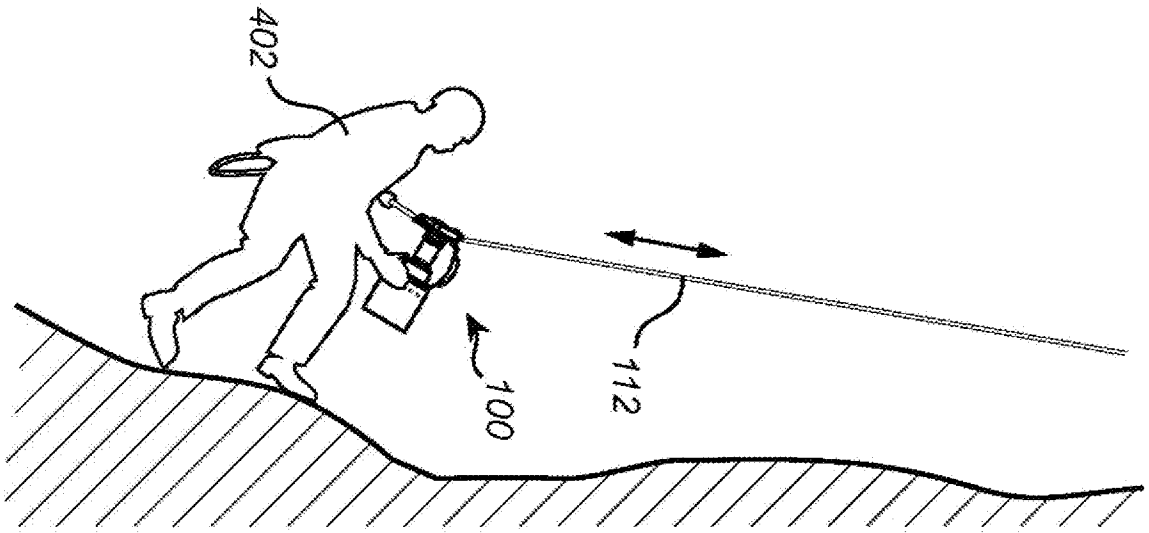
FIG. 4*a*-4*b* illustrates a vertical operation of the power driven system.
Figure 4B:
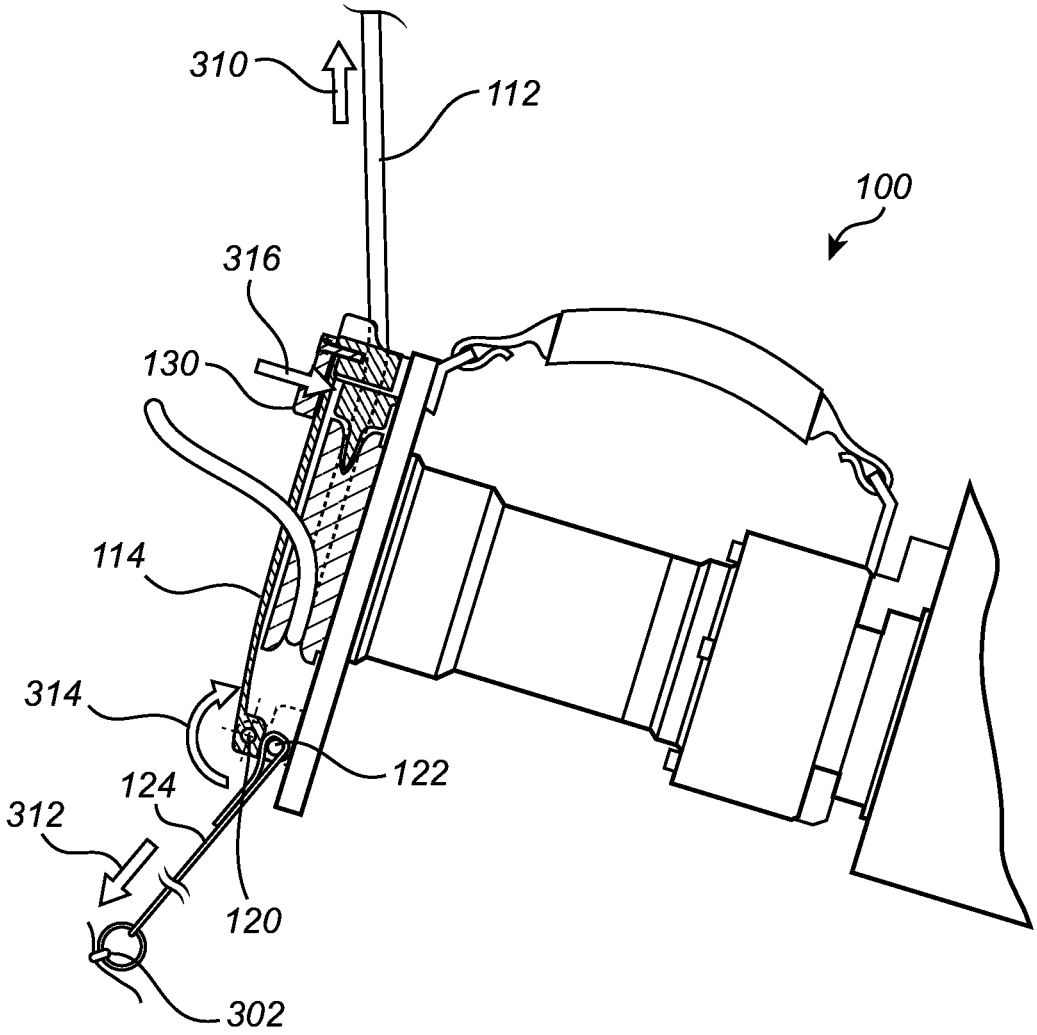

Turning now finally to FIGS. 4*a*-4*b*, which illustrates a vertical operation scenario for the power driven system 100. In this scenario, a user 402 having a safety harness is typically connected to the sling 126 in turn connected to the elongated pin 122 of the hinged safety arrangement 110. The rope will in this case typically be arranged at a fixed position above the user 402 (sometimes in relation to climbing denoted as "top rope"), the rope again extending in the first main direction 310. In a similar manner as in FIGS. 3*a*-3*c*, the anchoring force will act on the lever portion in an essentially opposite second direction 312 as compared to the first main direction 310. Hence, the hinged safety arrangement 110 will be forced to rotate 314 to its closed state.

Accordingly, the safety lid 114 is forced in a direction 316 such that it tightly fits around the rope grip 104. Again, not even a failure of the function of the locking/unlocking mechanism 130 would allow for the safety lid 114 to be opened as long as an anchoring force is present, thus minimizing any possibilities for the user 402 to come in contact with the rotating rope grip 104.

In summary, the present invention relates to a safety arrangement for a portable power driven system, such as an ascender/descender arrangement, specifically in relation to safety means for minimizing risks with items rotating during the operation of the power driven system. The invention is based on the understanding that the anchoring force received by the portable power driven system during its operation, for example when a user is ascending or descending the rope in a vertical manner and in such case is secured to the anchoring point of the portable system, efficiently may be used also for securing the safety lid in its closed state for minimizing any risks of the user coming in contact with the rotating rope grab. In accordance with the present invention, the anchoring force will act on the leaver portion of the safety arrangement, which in turn is attached to a fixed point, the hinge of the safety arrangement. Accordingly, the lever portion, which in turn is connected to the safety lid, will force the safety lid to its closed state.

Although the figures may show a specific order of method steps, the order of the steps may differ from what is depicted. Also two or more steps may be performed concurrently or with partial concurrence. Such variation will depend on designer choice. All such variations are within the scope of the disclosure. Additionally, even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A portable power driven system for advancing a rope, the rope extending in a first main direction, the power driven system comprising:

a motor, the motor comprising a drive shaft;

a rope grab configured to receive the rope, the rope grab connected to the drive shaft of the motor for rotation of the rope grab;

a hinged safety arrangement comprising a safety lid configured to be arranged in a closed state to fully cover the rope grab during operation of the power driven system, and to be arranged in an opened state for allowing introduction of the rope to the rope grab, and an anchoring point adapted to receive an anchoring force, the anchoring force extending in a second direction being essentially opposite to the first main direction, wherein the hinged safety arrangement further comprises a leaver portion connected to and extending in an angle to the safety lid, the anchoring point being arranged at the leaver portion, wherein the safety lid and the leaver portion are arranged essentially perpendicular to each other, whereby the anchoring force when acting on the anchoring point forces the safety lid to its closed state.

2. Portable power driven system according to claim 1, further comprising a main body for mounting the hinged safety arrangement.

3. Portable power driven system according to claim 1, wherein the safety lid and the leaver portion are formed from one piece of material.

4. Portable power driven system according to claim 3, wherein the one piece of material is metal.

5. Portable power driven system according to claim 1, wherein the leaver portion comprises an elongated pin, the elongated pin provided for receiving the anchoring force.

6. Portable power driven system according to claim 5, further comprising a safety sling connected to and enclosing a portion of the elongated pin, the safety sling arranged to receive at least one of a maillon, a carabiner, or a rigging plate.

7. Portable power driven system according to claim 1, wherein the rope grab has a concave form comprising a plurality of ridges for frictionally engaging the rope.

8. Portable power driven system according to claim 1, wherein the motor is at least one of an internal combustion engine or an electrical motor further comprising a rechargeable battery.

9. Portable power driven system according to claim 1, further comprising a user interface for operating the motor for allowing rotation of the rope grab in a first and a second direction.

* * * * *